US005492352A

United States Patent [19]

St. Clair

[11] Patent Number: 5,492,352

[45] Date of Patent: Feb. 20, 1996

[54] ROLLER BOARD

[76] Inventor: Robert A. St. Clair, 201 Berryman Rd. Apt 17, Vicksburg, Miss. 39180

[21] Appl. No.: 176,194

[22] Filed: Jan. 3, 1994

[51] Int. Cl.[6] ..... A63C 17/04

[52] U.S. Cl. ..... 280/87.042; 280/11.28

[58] Field of Search ..... 280/11.19, 11.22, 280/11.27, 11.28, 87.041, 87.042, 842

[56] References Cited

U.S. PATENT DOCUMENTS 3,399,904 9/1968 Schinke ..... 280/87.04
3,565,454 2/1971 Stevenson ..... 280/87.042
3,827,706 8/1974 Milliman ..... 280/87.04
4,062,557 12/1977 Roden ..... 280/11.27
4,886,298 12/1989 Shols ..... 280/87.042
5,096,225 3/1992 Osawa ..... 280/11.28

*Primary Examiner*—Richard M. Camby
*Attorney, Agent, or Firm*—David L. Baker; Robert A. Shack; Rhodes & Ascolillo

[57] ABSTRACT

In a preferred embodiment, a roller board for athletic training and recreational use, which includes a generally flat, elongated, horizontal board member and a first plurality of selectively removable wheels attached to a lower surface of the board member. The first plurality of wheels are sequentially aligned and parallel to a longitudinal axis of the board member.

4 Claims, 2 Drawing Sheets

ROLLER BOARD

BACKGROUND OF THE INVENTION

1. Field of the Invention

The present invention relates to athletic training and recreational devices generally and, more particularly, but not by way of limitation, to a novel athletic training and recreational device which combines the features of skateboards and rollerblades.

2. Description of the Related Art

U.S. Pat. No. 3,399,904, issued Sep. 3, 1968, to Schinke, describes a skateboard mounted on small wheels or swivel wheels such as casters with the board being of a size to accommodate either one foot or both feet of an operator and which can be manipulated for movement by the use of the feet, legs, and body of the operator.

U.S. Pat. No. 3,827,706, issued Aug. 6, 1974, to Milliman, describes wheeled skis which comprise two elongated boards with provision for the attachment thereto of ski boots. On the lower surface of each ski are disposed pairs of fixed tracking wheels at the front and rear of the ski boot. Fore and aft of the pairs of fixed wheels are centrally disposed turning wheels which can turn about in a horizontal plane. The combination of tracking and turning wheels simulates the motions performed in conventional snow skiing.

U.S. Pat. No. 4,062,557, issued Dec. 13, 1977, to Roden, describes an eight wheel skateboard having front and rear trucks each supporting four wheels centrally pivoted to the axle on the under carriages of the skateboard normally provided for the the conventional type front and rear wheels.

U.S. Pat. No. 4,886,298, issued Dec. 12, 1989, to Shols, describes a roller ski which includes an elongated frame member with pairs of casters at either end thereof. Disposed centrally of, and attached to, the frame is a spring biased platform which has a pair of rollers at either end thereof, the rollers being biased away from contact with the ground when no one is on the skis. When in use, weighting of the skis causes the central platform to rotate with respect to the frame and one or both pairs of rollers to contact the ground.

U.S. Pat. No. 5,096,225, issued Mar. 17, 1992, to Osawa, describes grass ski roller boards which have elongated base members having the general appearance of snow skis. Pairs of rollers are spaced apart along the lower surfaces of the base members.

SUMMARY OF THE INVENTION

Skateboards and other similar devices have become very popular in recent years as athletic training and recreational devices. They generally comprise a platform of one of a number of shapes with wheels attached to the bottom surface thereof. A user is self-propelled by using ski-type poles, by pressing one foot against the ground, or by gliding down a slope.

Another popular device for athletic training and recreation is the rollerblade which is a skate having a plurality of narrow in-line wheels as compared with conventional roller skates which have two, spaced apart pairs of relatively wide wheels. The rollerblade is lighter than the conventional skate and offers greater speed and maneuverability. It would therefore be desirable to combine the advantages of the rollerblade with a skateboard type of device.

Accordingly, it is a principal object of the present invention to provide a athletic training and recreational device that combines features of rollerblades and skateboards.

It is a further object of the invention to provide such a device that can be economically constructed.

The present invention achieves the above objects, among others, by providing in one aspect a roller board for athletic training and recreational use which includes a generally flat, elongated, horizontal board member and a first plurality of selectively removable wheels attached to a lower surface of the board member.. The first plurality of wheels are sequentially aligned and parallel to a longitudinal axis of the board member.

Preferably, the roller board also includes a second plurality of selectively removable wheels attached to the lower surface of the board member. The second plurality of wheels are also sequentially aligned and parallel to the longitudinal axis of the board member, with the second plurality of wheels being paired side by side with the first plurality of wheels. Adjacently placed wheels in each of the first and second pluralities of wheels are spaced apart by less than one-quarter wheel diameter. A corresponding pair of first and second pluralities of wheels has a center-to-center, side-by-side distance of less than one wheel diameter.

In another aspect, the invention generally provides a roller board for athletic training and recreational use, which includes a generally flat, elongated, horizontal board member, a plurality of selectively removeable wheel attachment base plates connected to a lower surface of the board member, a wheel mount attached to the wheel attachment base plate, and at least one wheel yoke connected to the wheel mount for housing a plurality of wheels. The wheel yoke generally has a U-shaped frame.

Preferably, the wheel mount further includes a wheel alignment and support cantilever member attached to one end of the wheel mount. The wheel alignment and support cantilever member further includes an elongated shaft member and a rounded knob attached to one end of the elongated shaft. Additionally, the wheel attachment base plate further includes an inwardly inclined mounting socket for engaging and supporting the wheel alignment and support cantilever member, with the mounting socket being attached to a front edge of the wheel attachment base plate. The wheel attachment base plate also includes an inwardly inclined shock mounting member for redirecting forces along a plane parallel to the longitudinal axis of the board member, with the shock mounting member being attached to a rear edge of the wheel attachment base plate. Finally, the roller board further includes a threadingly adjustable, shock absorbing grommet removably connected between the wheel mount and the shock mounting member.

BRIEF DESCRIPTION OF THE DRAWINGS

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENT

Figures 1, 2, 3:
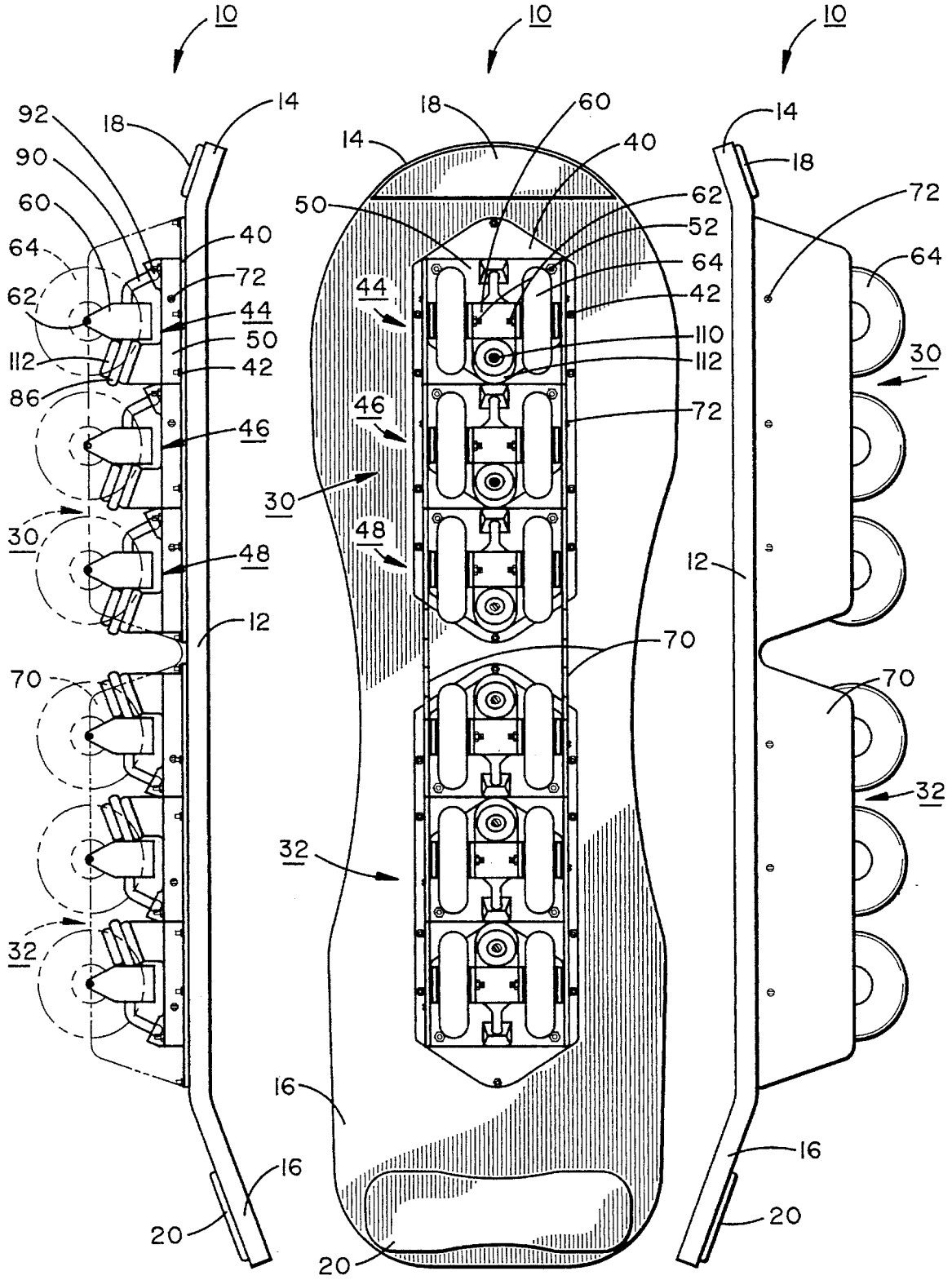
FIG. 1 is a bottom plan view of a roller board constructed according to the present invention.
FIG. 2 is a side elevational view of the roller board.
FIG. 3 is a side elevational view, partially cut-away, of the roller board.
Figure 4:
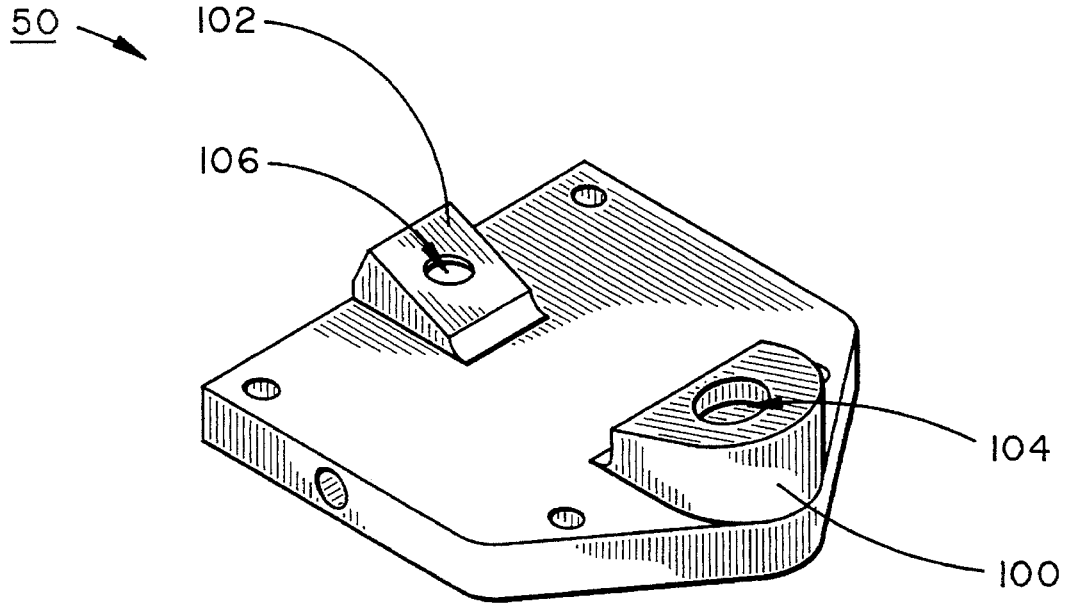
FIG. 4 is a perspective view of a wheel frame base for the roller board.
Figure 5:
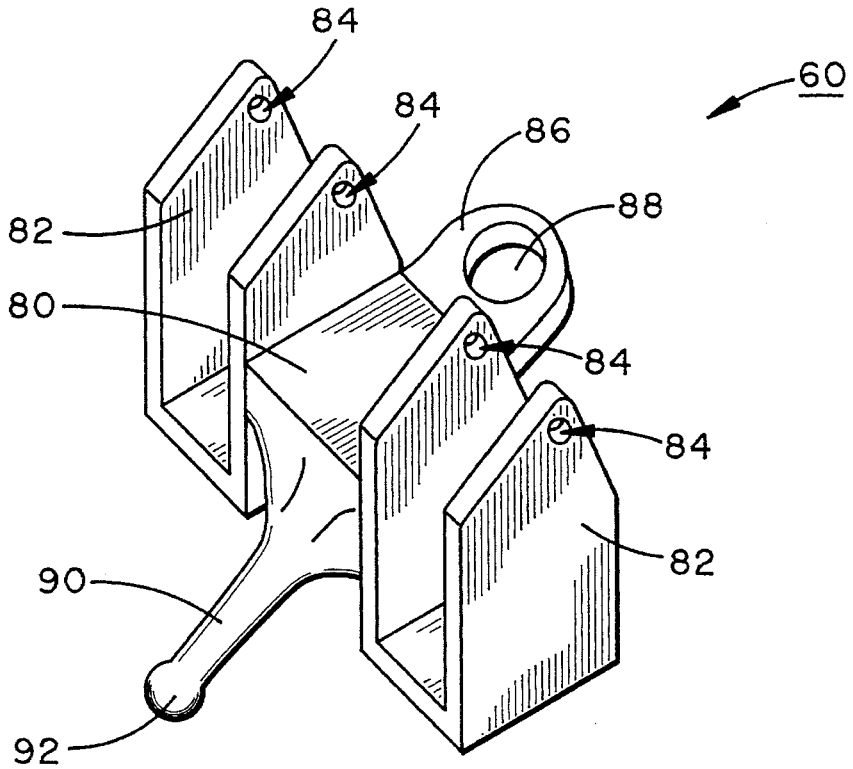
FIG. 5 is a prespective view of a wheel frame for the roller board.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Reference should first be made to FIGS. 1–3 together whereon there is illustrated a roller board constructed according to the present invention, generally indicated by the reference numeral 10. Roller board 10 includes a generally flat, horizontal board member 12 having upwardly inclined, relatively short portions 14 and 16 at the front and rear thereof, respectively, to which are attached skid pads 18 and 20, respectively.

Disposed on the lower surface of board member 12 are two wheel assemblies, generally indicated by the reference numerals 30 and 32. Since wheel assemblies 30 and 32 are identical, only wheel assembly 30 will be described in detail. Wheel assembly 30 includes a metallic frame 40 attached to board member 12 by means of threaded fasteners, as at 42 (FIGS. 1 and 3). Wheel assembly 30 includes three identical wheel pairs generally indicated by the reference numerals 44, 46, and 48 (FIGS. 1 and 3). Since wheel pairs 44, 46, and 48 are identical, only wheel pair 44 will be described in detail. Wheel pair 44 includes a wheel attachment base plate 50, of molded hard plastic, attached to the frame 40 by means of a plurality of threaded fasteners, as at 52. Mounted on wheel attachment base plate 50 is a cast metal wheel mount 60 having journalled therein, on shafts 62, two side-by-side wheels 64. Completing roller board 10 are plastic side trim panels 70 attached to wheel attachment base plates 50 by means of threaded fasteners, as at 72.

Reference should now be made to FIGS. 1 and 3–5 for an understanding of the details of the mounting of wheels 64. Wheel mount 60 (FIG. 5) includes a horizontal, flat, central portion 80 having attached to either side thereof upwardly open, U-shaped wheel yokes 82 having horizontally aligned openings 84 defined through the upper edges thereof for the placement therebetween of shafts 62 (FIG. 3). Attached to and extending rearwardly from central portion 80 (FIG. 5) is an upwardly inclined portion 86. Attached to and extending forwardly from the central portion is a wheel alignmemt and support cantilever member 90 having a rounded knob portion 92 formed at the distal end thereof.

The wheel attachment base plate 50 (FIG. 4) includes an inwardly inclined shock mounting member 100 attached at the rear edge thereof and an inwardly inclined mounting socket 102 attached at the front edge thereof. The shock mounting member 100 has a opening 104 defined therethrough and the mounting socket 102 has a generally spherical cavity 106 defined therein.

The wheel mount 60 is attached to wheel attachment base plate 50 by means of a threaded fastener/washer 110 (FIG. 1) inserted through opening 88 (FIG. 5) into opening 104 in the shock mounting member 100 (FIG. 4), with a rubber grommet 112 (FIG. 3) captured in the opening and extending from the top and bottom surfaces of inclined portion 86 (FIG. 5) for shock absorbing purposes and to permit the wheel mount 60 to rotate slightly about a longitudinal axis for steering purposes. Knob 92 (FIG. 5) on cantilever member 90 is inserted in another rubber grommet (not shown) disposed in cavity 106 (FIG. 4), for the same purposes.

It can be seen, particularly on FIG. 1, that wheels 64 of each roller assembly 30 and 32 of roller board 10 are closely spaced front-to-back and are separated by less than one-quarter the diameter of the wheels. The center-to-center, side-by-side spacing of a pair of wheels 64 is less than one wheel diameter. Wheel assemblies 30 and 32, consequently resemble two rollerblades having double rows of wheels. Alternatively, another version of roller board 10 requiring more skill would have aligned single rows of wheels 64 in wheel assemblies 30 and 32.

Roller board 10 is used in the conventional manner of skateboards, with the user placing one foot on the upper surface of board member 12 and pressing the other foot against the ground to provide propulsion.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A roller board for athletic training and recreational use, comprising:

(a) a generally flat, elongated, horizontal board member;

(b) a plurality of selectively removable wheel attachment base plates, connected to a lower surface of said board member;

(c) a wheel mount, attached to said wheel attachment base plate, comprising a wheel alignment and support cantilever member attached to one end of said wheel mount;

said wheel alignment and support cantilever member further comprises an elongated shaft member and a rounded knob attached to one end of said elongated shaft member; and (d) at least one wheel yoke connected to said wheel mount for housing a plurality of wheels, said at least one wheel yoke having a generally U-shaped frame.

2. A roller board for athletic training and recreational use, as defined in claim 1, wherein said wheel attachment base plate further comprises an inwardly inclined mounting socket for engaging and supporting said wheel alignment and support cantilever member, said mounting socket being attached to a front edge of said wheel attachment base plate.

3. A roller board for athletic training and recreational use, as defined in claim 2, wherein said wheel attachment base plate further comprises an inwardly inclined shock mounting member for redirecting forces along a plane parallel to said longitudinal axis of said board member, said shock mounting member being attached to a rear edge of said wheel attachment base plate.

4. A roller board for athletic training and recreational use, as defined in claim 3, wherein said roller board further comprises a threadingly adjustable, shock absorbing grommet removably connected between said wheel mount and said shock mounting member.

* * * * *